US005668582A

United States Patent [19]

Manzone et al.

[11] Patent Number: 5,668,582

[45] Date of Patent: Sep. 16, 1997

[54] PRINTER WITH INTERCHANGEABLE PRINTING HEADS

[75] Inventors: Mario Manzone, Mazze' ; Piero Pace, Banchette, both of Italy

[73] Assignee: Ing. C. Olivetti & C., S.p.A., Ivrea, Italy

[21] Appl. No.: 317,544

[22] Filed: Oct. 4, 1994

[30] Foreign Application Priority Data

Oct. 11, 1993 [IT] Italy ..... TO93A0734

[51] Int. Cl.[6] ..... B41J 2/14

[52] U.S. Cl. ..... 347/49; 347/50

[58] Field of Search ..... 347/49, 50; 346/139; 400/82, 229, 692

[56] References Cited

U.S. PATENT DOCUMENTS

| | | | |
|---|---|---|---|
| 3,787,880 | 1/1974 | Kattner et al. | 400/692 |
| 4,707,154 | 11/1987 | Arai | 400/229 |
| 4,755,836 | 7/1988 | Ta et al. | 347/49 |
| 4,778,291 | 10/1988 | Mitsuhashi | 400/692 |
| 4,803,500 | 2/1989 | Milbrandt | 347/49 |
| 4,872,027 | 10/1989 | Buskirk | 347/49 |
| 5,049,904 | 9/1991 | Nakamura et al. | 347/47 |
| 5,372,512 | 12/1994 | Wilson et al. | 439/67 |

FOREIGN PATENT DOCUMENTS

| | | |
|---|---|---|
| 195949 | 5/1990 | European Pat. Off. . |
| 63-130346 | 6/1988 | Japan . |
| WO 90/08040 | 7/1990 | WIPO . |

*Primary Examiner*—Mark J. Reinhart
*Assistant Examiner*—L. Anderson
*Attorney, Agent, or Firm*—Banner & Witcoff, Ltd.

[57] ABSTRACT

An ink jet printing head 14 is mounted on a movable carriage 13 and a fixing device 32 removably fixes the head 14 by means of a hook 111 adapted to cooperate with a shoulder of the head 14 or an alternative priming head 16 of the wire type. An electronic control unit 22 controls a control device 156 adapted to recognize which type of head is mounted on the carriage 13 and actuates it.

6 Claims, 6 Drawing Sheets

PRINTER WITH INTERCHANGEABLE PRINTING HEADS

FIELD OF THE INVENTION

This invention relates to a printer with interchangeable printing heads, comprising a carriage for supporting an ink jet printing head and moving it along a print line, a fixing device for removably fixing the ink jet head or an alternative printing head to the carriage and a control device for controlling the ink jet head and the alternative printing head.

BACKGROUND OF THE INVENTION

A printer of this type is known, in which the ink jet head is monochrome and the alternative head is also an ink jet head, but can print several colors and can be mounted as an alternative to the monochrome head on the carriage of the printer. The control device is adapted to recognize the type of head mounted and to control it both in the case of the monochrome head and in the case of the head printing several colors.

A printer with two ink jet printing heads, one of the monochrome type and another of the multicolor type, is also known, the two heads being mounted together on the carriage and being controlled and actuated by one single control device.

A wire printer is also known, on which one printing head of a series of printing heads, respectively of the type having 9, 18 or 24 wires, can be mounted. For the relevant control, a specialized control device for the head having 9, 18 or 24 wires must be mounted actually on the printer.

The printers of the prior art use alternative printing heads which are different with respect to several features, such as the color of the ink and/or the number of dots of the printing matrix, but which use the same technology. These printers therefore have the advantages and the disadvantages associated with the technology of the heads that can be used. E.g. ink jet printers, although displaying optimum print quality, involve relatively high overall costs for the head and ink and therefore for each character printed. It is moreover impossible to produce "carbon" copies, as required in banking. Printers with wire heads for their part have low printing costs and allow for the compilation of multiple copies, but offer a relatively mediocre print quality.

SUMMARY OF THE INVENTION

Preferred embodiments of the invention provide a printer which is capable of using printing heads of various technologies and which can be mounted and exchanged with one another in a simple manner so as to obtain various effects optimised in accordance with the requirements of the user.

The invention is defined in its various aspects in the appended claims to which reference should now be made.

BRIEF DESCRIPTION OF THE DRAWINGS

An embodiment of the invention will now be described in detail by way of example with reference to the accompanying drawings, in which.

DETAILED DESCRIPTION OF PREFERRED EMBODIMENTS

Figure 1:
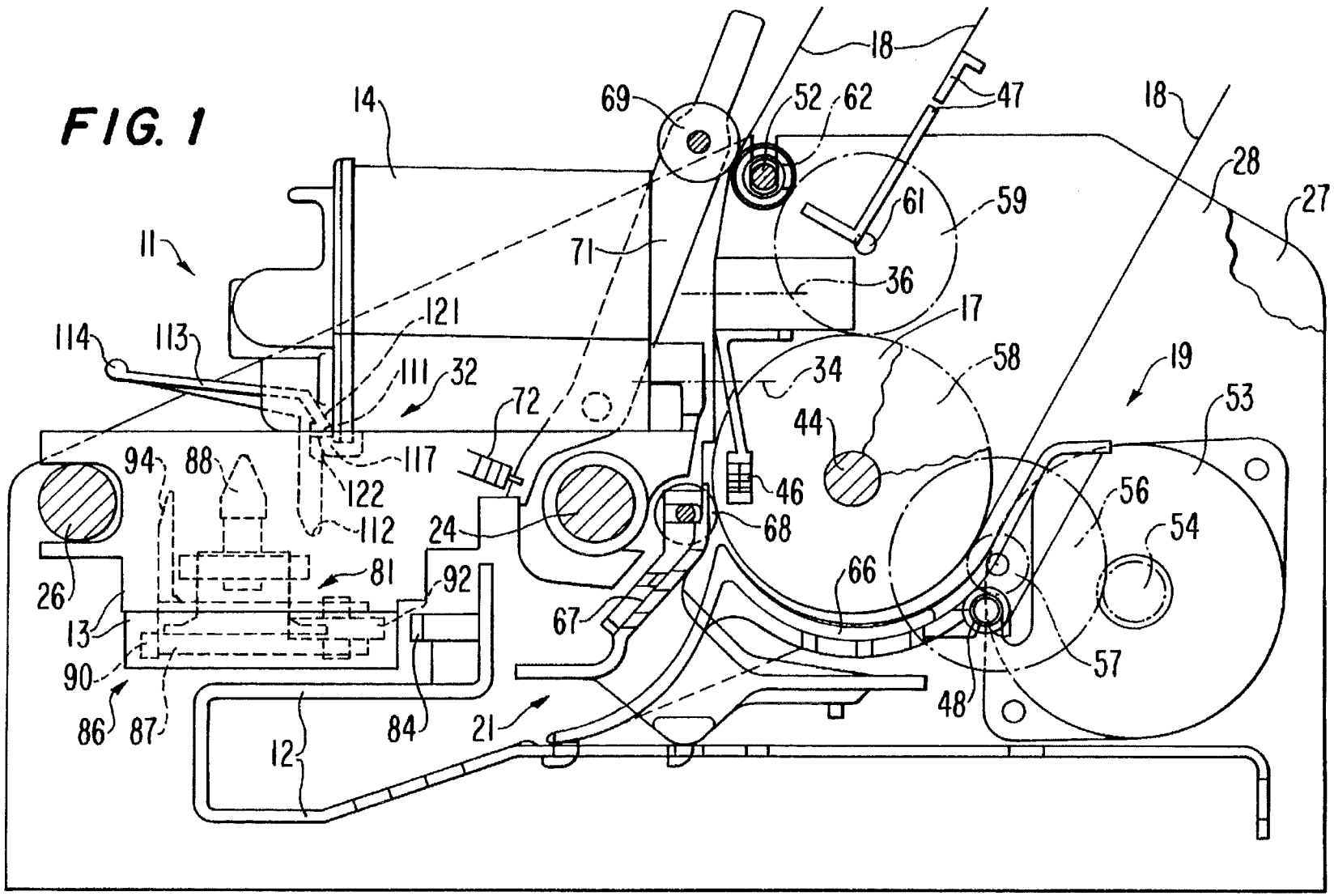
FIG. 1 is a partial longitudinal view of a printer with a printing head embodying to the invention.
Figure 2:
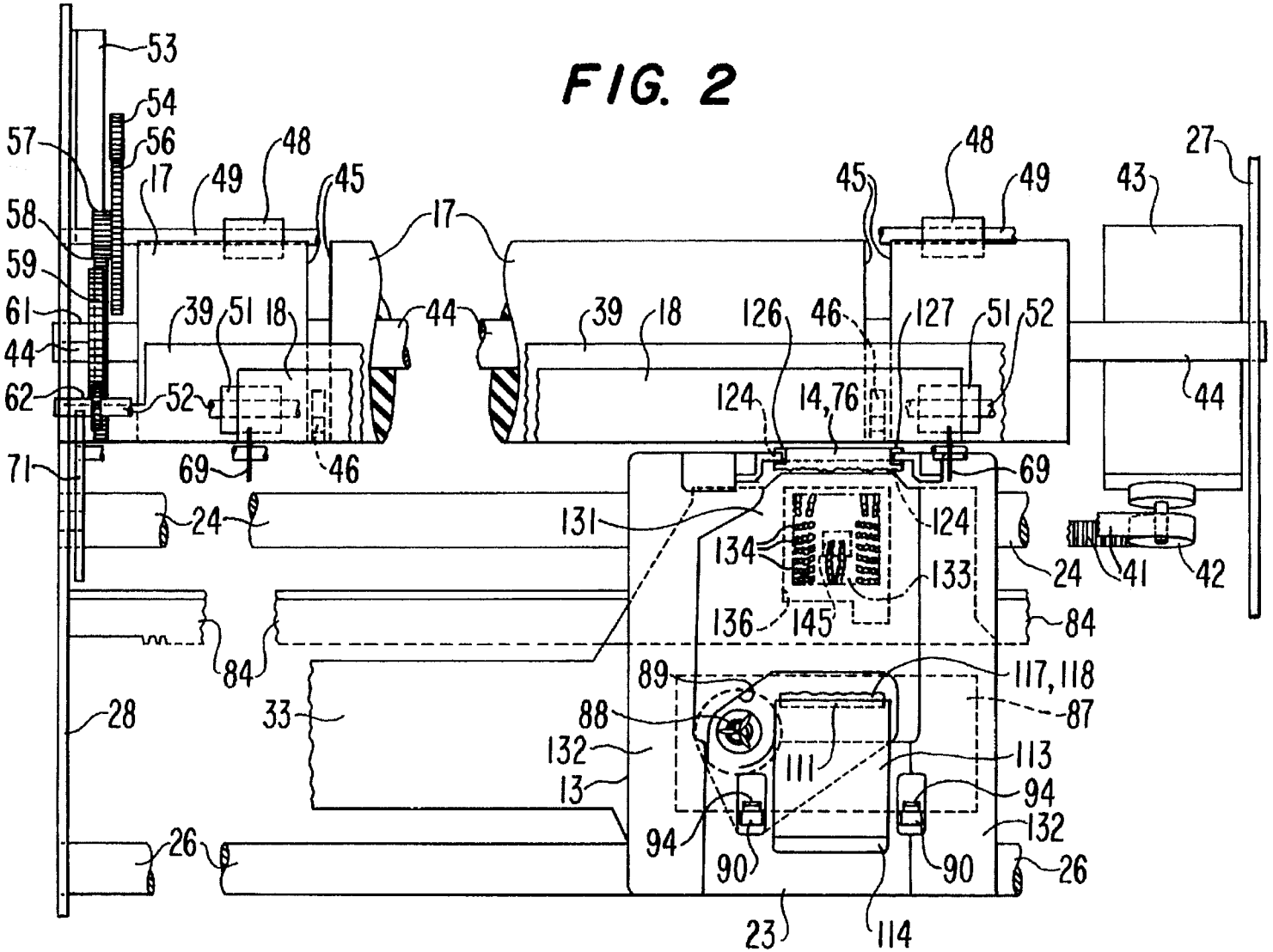
FIG. 2 is a partial plan view of the printer of FIG. 1 on a different scale.
Figure 3:
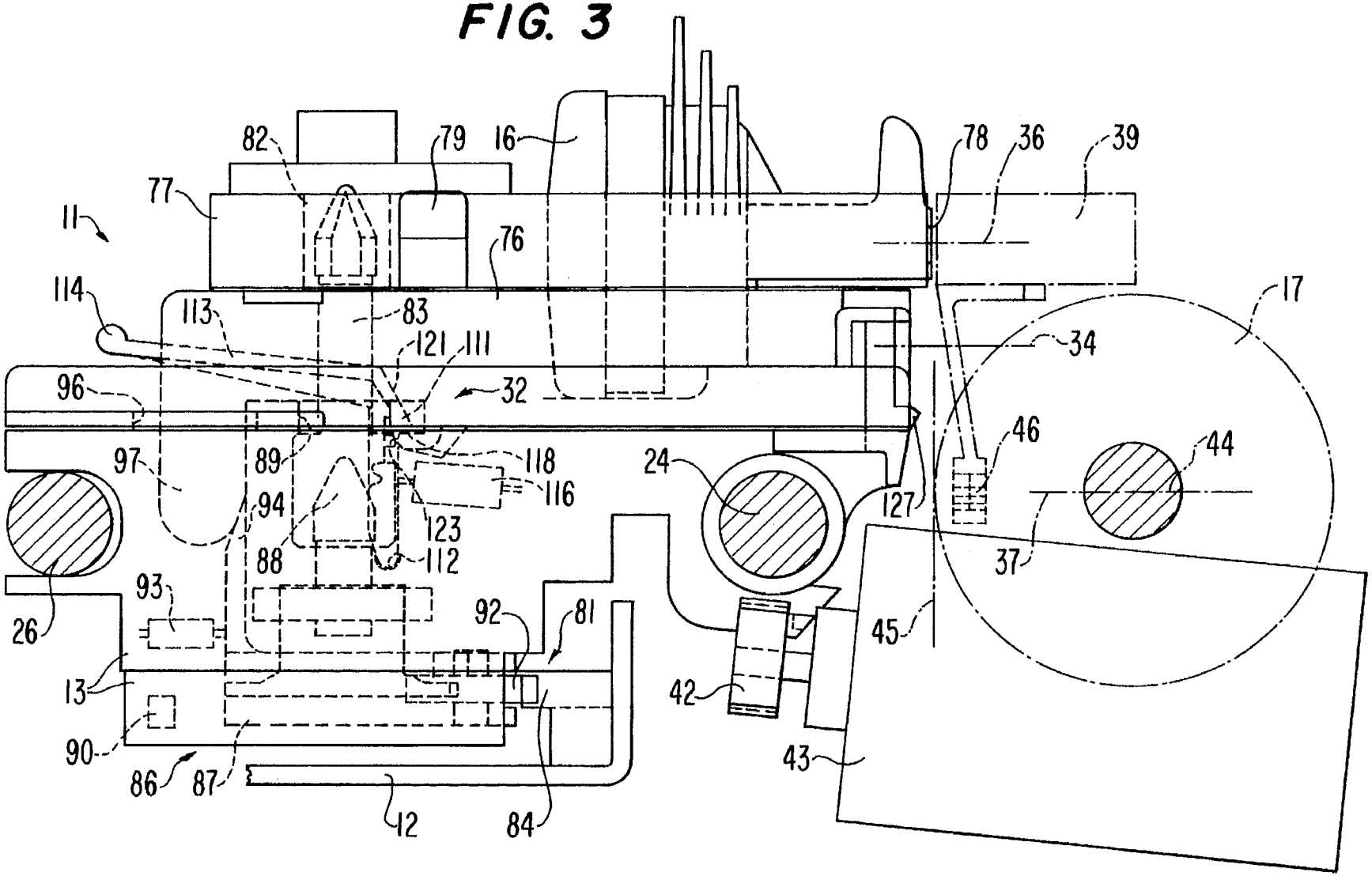
FIG. 3 is a partial longitudinal view of the printer of FIG. 1 with a second printing head.

With reference to FIGS. 1 to 8, a printer embodying the invention, designated in general by the reference numeral 11, comprises a fixed frame 12, a movable carriage 13 with a printing head 14 or an alternative printing head 16, a supporting roller 17 for a sheet of paper 18, a spacing device 19, a paper guiding device 21 and an electronic control unit 22 for controlling the various functions of the printer 11.

The carriage 13 comprises a body having a substantially rectangular section defined by an upper plane 23 and is slidable alternately on two shafts 24 and 26 fixed at the ends to two lateral flanks 27 and 28 of the frame 12.

The printing head 14 is of the ink jet type, while the alternative printing head 16 is of the wire type. A fixing device, designated in general by the reference numeral 32, is adapted to fix the ink jet head 14 or the wire head 16 in a removable manner to the upper plane 23 of the carriage 13. The electronic unit 22 is mounted on the frame 12 and can be electrically connected to the heads 14 or 16 by means of a flat, flexible cable 33.

The head 14 or the alternative head 16 is adapted to define a print line 34 and a print line 36 respectively to move the carriage 13 along the shafts 24 and 26. The lines 34 and 36 can, but need not, be disposed, e.g. at different heights with respect to a horizontal geometric plane 37 passing through the axis of the roller 17.

A holding bar 39 is fixed between the flanks 27 and 28, above the roller 17. When the printer 11 mounts the wire printing head 16, the bar 39 is adapted to cooperate with the sheet 18 along the print line 36 and to oppose the action of the wires of the heads 16 during the printing cycles.

The carriage 13 is moved by a toothed belt 41 which is returned by a pulley, rotating on the flank 28 and not shown in the drawings, and has an arm to which the carriage 13 is fixed in a known manner. The belt 41 is always engaged with a pinion 42 of a stepping motor 43 fixed to the flank 27 and controlled by the electronic unit 22.

The roller 17 is made of rubber, is fixed to a shaft 44 rotating between the flanks 27 and 28 and has the dual function of guiding and feeding the sheet of paper 18.

The sheet follows a substantially flat, vertical course in front of the head 14 or 16, defined by the holding bar 39 and by a vertical geometric plane 45 tangential to the roller 17. The print line 34 associated with the head 14 is disposed between the bar 39 and the geometric plane 37 passing through the axis of the roller 17.

Two sensors 46 for detecting the presence of the paper indicate to the electronic control unit 22 the presence or the absence of the sheet of paper 18. The roller 17 consists of three parts arranged at intervals from one another and the sensors 46 are housed in the two seats 45 defined by the divisions between these parts.

The spacing device 19 is adapted to feed the sheet of paper 18 in increments towards the print lines 34 and 36 and then to feed the sheet of paper 18 downstream of the print lines 34 and 36 and to convey it into a sheet container 47.

The roller 17 and rubberized rollers 48 fixed to a shaft 49 parallel to the shaft 44 behind the roller contribute to the feeding action of the sheet 18. Conveying towards the container 47 is promoted by rubberized rollers 51 fixed to a shaft 52 likewise parallel to the shaft 44.

The roller 17 and the rollers 48 and 51 are motorised by a stepping motor 53 controlled by the electronic unit 22.

The movement imparted to the rollers 48 is provided by a pinion 54 of the motor 53 which is engaged with a toothed wheel 56 keyed on to the shaft 49. A sprocket 57 fixed to the shaft 49 is in turn engaged with a toothed wheel 58 keyed on to the shaft 44 and transfers its rotation to the roller 17.

Finally, the toothed wheel 58 transmits the movement to the rollers 51 by means of an intermediate toothed wheel 59 rotating on a shaft 61 and in engagement with a pinion 62 keyed on to the shaft 52.

The paper guiding device 21 comprises a conventional lower tile 66 disposed below the roller 17 and a small front tile 67 disposed in front of the roller 17. Paper finger rollers 68 rotating on the tile 67 cooperate with the roller 17 for feeding the sheet 18 towards the print lines 34 and 36.

For the movement of the sheets 18 beyond the print lines 34 and 36, the device 19 comprises paper finger rollers 69 adapted to cooperate with the sheet 18, in contrast to the rollers 51. The rollers 69 are mounted on a movable frame 71 hinged between the flanks 27 and 28 parallel to the shaft 52 and are pushed towards the rollers 51 by the action of a spring 72 on the frame 71.

The action of conveying the sheet 18 towards the container 46 could cause problems when the printer 11 uses an ink jet head 14. As is known, it is needed some time before a body can cooperate with the part of the sheet on which the ink is deposited by the ink jet head without causing smudges.

The paper finger rollers 69 are advantageously rigid and have a thickness limited to 0.8 mm. With this arrangement, when the printer 11 mounts the ink jet head 14, the spacing speed does not have to be reduced in order to ensure that the ink is completely dry. The limited thickness of the paper finger rollers 69 allows for feeding of the sheet 18 while the ink is still wet without causing any significant smudges and blotches on the said sheet 18.

The printing heads 14 and 16 can have various dimensions, shapes and performances without going beyond the scope of this invention. In addition to the head 14 of FIG. 1, a different ink jet head 14', e.g. of the color type, has been shown by way of a non-limiting example in FIG. 5 and a generic wire head 16 has been shown by way of a non-limiting example in FIG. 3.

The ink jet printing head 14 is preferably of the bubble type with fifty nozzles controlled by corresponding resistors for vaporising the ink. A printing head of this type is used in the Ing. C. Olivetti & C., S.p.A. JP-350 printer. The wire head 16 is preferably of the type having nine wires actuated by corresponding electromagnets, described, e.g. in European Patent No. 0 106 657 of Ing. C. Olivetti & C., S.p.A.

For use in the printer 11, the wire printing head 16 is fixed to an intermediate frame 76 which is moreover adapted to support a cartridge 77 for a ribbon 78 in a removable manner. The removal of the head 16 leads to the simultaneous removal of the cartridge 77.

The cartridge 77 is fixed to the frame 76 in a known manner, e.g. by means of two resilient plates 79 disposed laterally of and projecting from the said frame. It can be removed separately from the frame 76 when the ribbon 78 is used up or when it is desired to replace the cartridge 77 with one of a different type. Only one resilient plate 79 can be seen in the drawings.

The ribbon 78 is in fact fed by a ribbon feeding mechanism 81 by means of a drive element 82 of the cartridge 77 and a transmission shaft 83 rotating on the frame 76. The mechanism 81 comprises a rack 84 fixed between the flanks 27 and 28 parallel to the shafts 24 and 26 and a kinematic unit 86 housed in the lower part of the carriage 13. The unit 86 comprises a slide 87 with an output shaft 88 disposed in front of an opening 89 in the carriage 13 and two pinions 91 and 92 disposed side by side in front of the rack 84.

A spring 93 holds the slide 87 locked against two stops 90 and the unit 86 in a forward idle position (FIG. 1) in which the two pinions 91 and 92 are at a distance from the rack 84. The unit 86 can assume a back working position (FIG. 3), in which the two pinions 91 and 92 engage with the rack 84 in order to feed the ribbon 78.

To this end, the slide 87 is provided with two fins 94 projecting upwards and aligned with two openings 96 in the carriage 13 and the frame 76 has two extensions 97 projecting downward and adapted to cooperate with the fins 94.

The mounting of the head 16 on the carriage 13 causes the extensions 97 of the frame 76 to engage the fins 94 and the transmission shaft 83 to engage the shaft 88, through the openings 96 and 89. The slide 87 is displaced backwards against the action of the spring 93 and causes the pinions 91 and 92 to engage with the rack 84.

The kinematic unit 86 also comprises a toothed wheel 98 synchronous with the shaft 88 and back gears comprising a sprocket 99 engaged with the toothed wheel 98, a first toothed wheel 101 integral with the sprocket 99 and an intermediate wheel 102 engaged with the toothed wheel 101.

The pinions 91 and 92 are slidable via respective pivots 103 and 104 in corresponding slots 106 and 107 parallel to the rack 84 to engage selectively with the toothed wheels 101 and 102.

In the working position of the unit 86, the pinions 91 and 92 rotate the gears of the unit 86 and feed the ribbon 78 in one direction in response to bidirectional movements of the carriage 13. The engagement of the pinions 91 and 92 with the rack 84 and their freedom of movement with respect to the slide 87 cause relative movement between the pivots 103 and 104 and the slots 106 and 107 in a direction opposite to that of the carriage 13.

Figure 4:
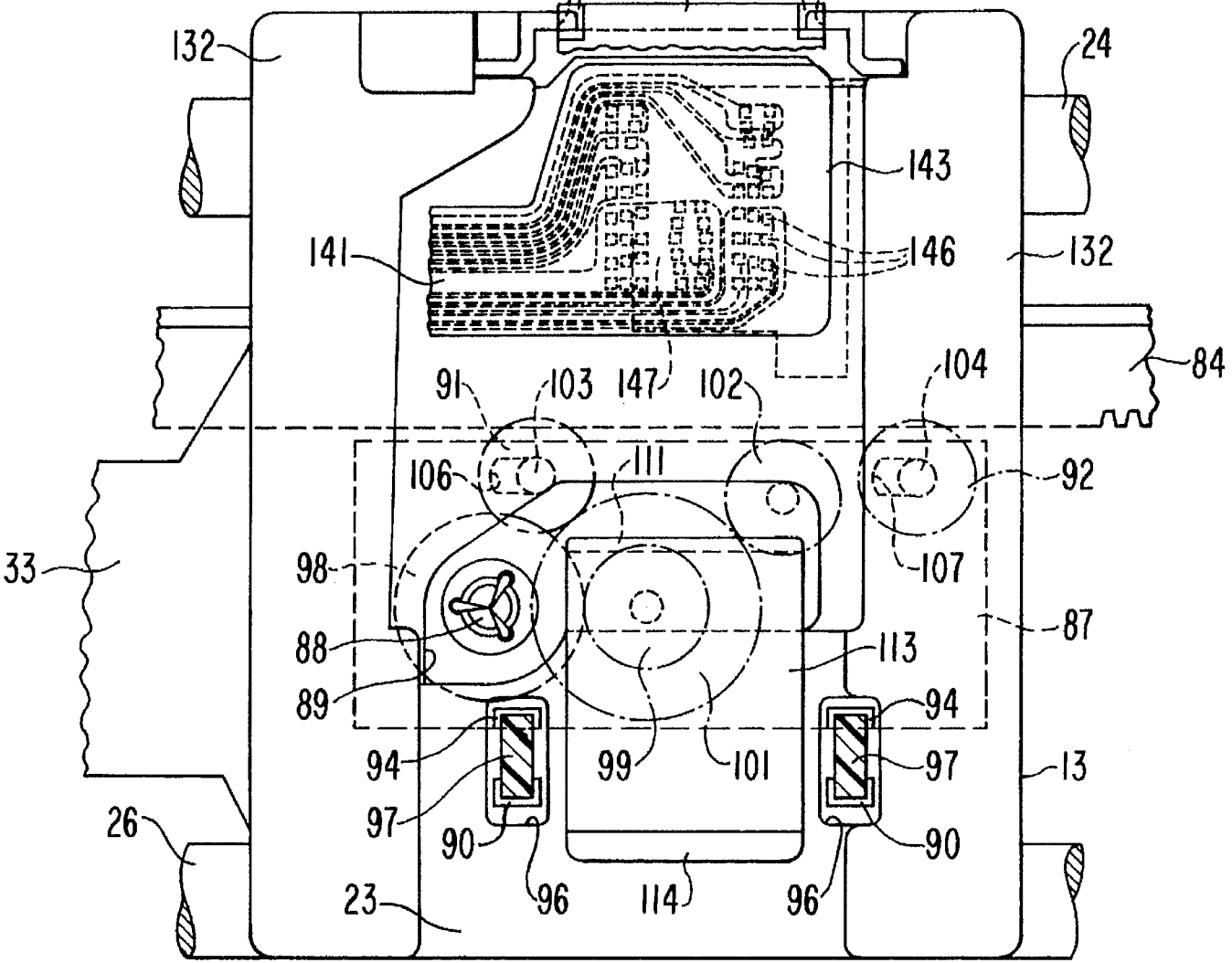
FIG. 4 is a partial plan view of the printer of FIG. 3.
Figure 5:
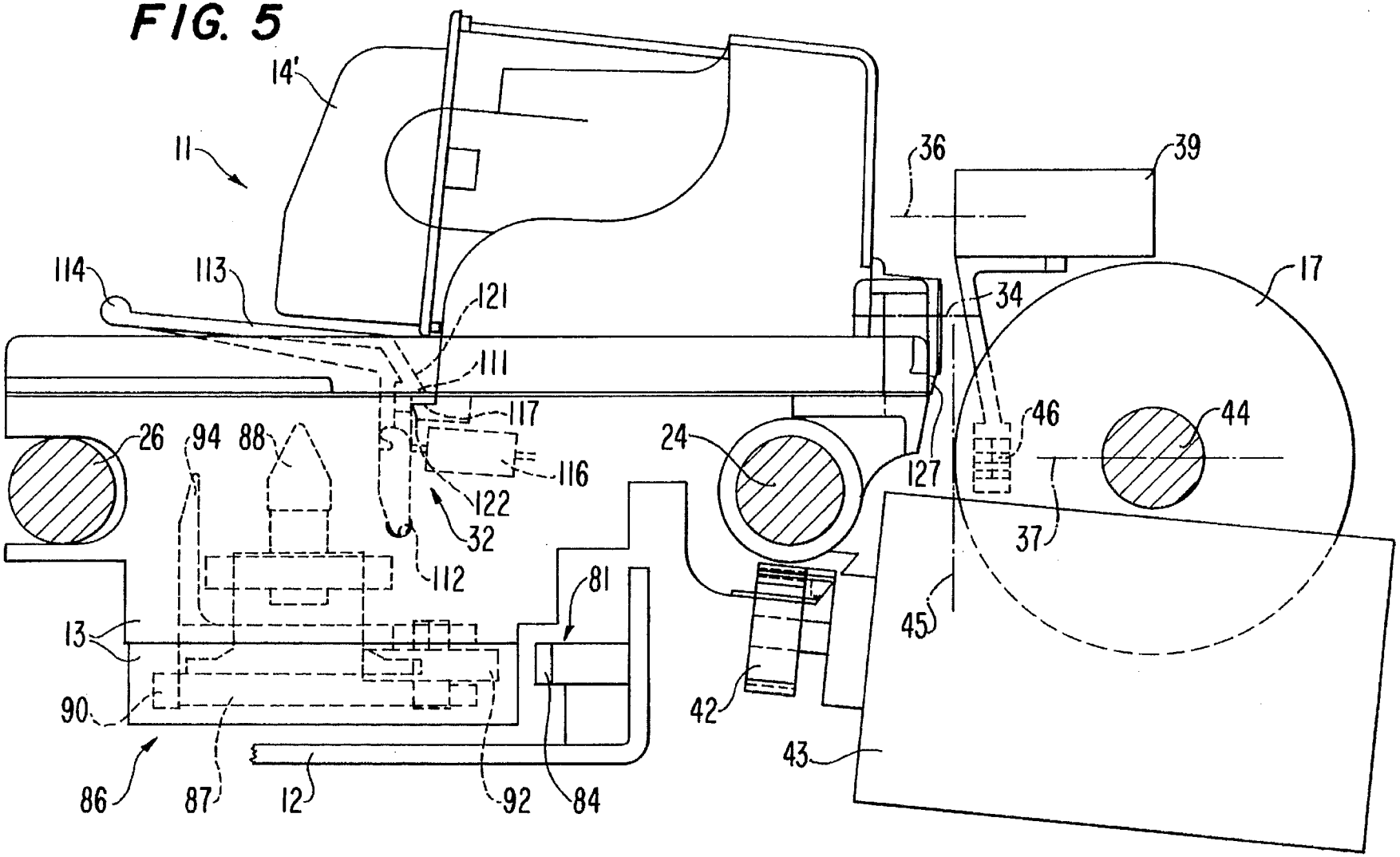
FIG. 5 is a partial schematic longitudinal view of the printer of FIG. 1 with a third printing head on a different scale.
Figure 7:
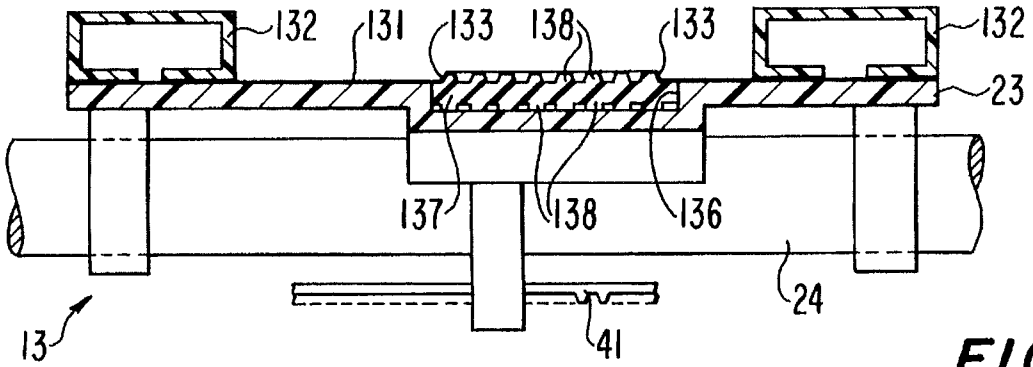
FIG. 7 is a partial section of several details from FIG. 4 on a different scale.
Figure 8:
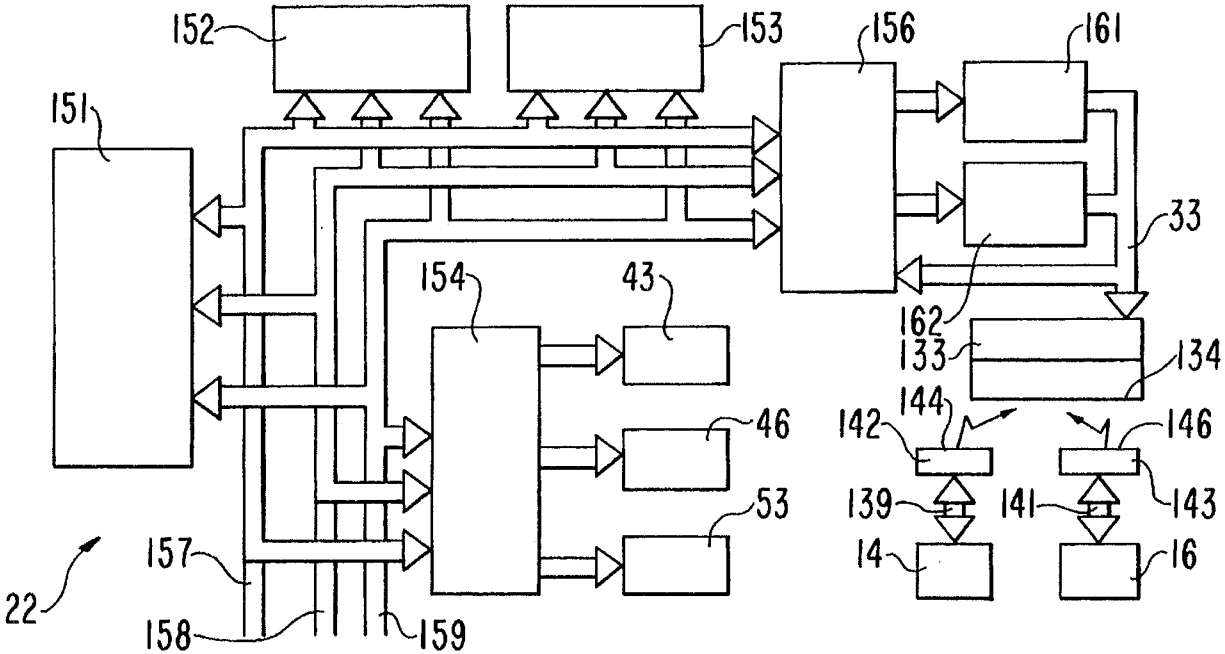
FIG. 8 is a logic block diagram of a control unit for the printer of FIG. 1.
Figure 6:
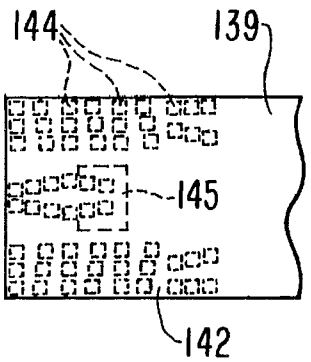
FIG. 6 is a partial plan view of a detail from the printing head of FIG. 1.

If the motor 43 displaces the carriage 13 in a certain direction of movement along the print line, e.g. towards the left in FIG. 4, the pinions 91 and 92 are displaced towards the right relative to the slide 87 and are rotated in a clockwise direction. The pinion 91 then engages with the toothed wheel 101, while the pinion 92 is released from the intermediate toothed wheel 102 and carries its pivot 104 to an end of stroke to the right of the slot 107. The rotation of the pinion 91 causes rotation of the shaft 88 in the same clockwise direction by means of the first toothed wheel 101, the sprocket 99 and the toothed wheel 98.

If the carriage 13 is displaced in the opposite direction, e.g. towards the right in FIG. 4, the pinions 91 and 92 slide together with their pivots 103 and 104 towards the left in the slots 106 and 107 and rotate in an anticlockwise direction. The pinion 91 is released from the first toothed wheel 101, while the pinion 92 is engaged with the intermediate wheel 102.

The anticlockwise rotation of the pinion 92 therefore also in this case causes clockwise rotation of the shaft 88, by means of the intermediate wheel 102, the first toothed wheel 101, the sprocket 99 and the toothed wheel 98, thereby always feeding the ribbon in the same direction.

The fixing device 32 is unique for the single head 14 or 14' and for the frame 76 with the head 16. It comprises a hook 111 movable in a seat 112 of the carriage 13 between a first and a second position. In the first position, the hook 111 holds the head 14 or the frame 76 with the wire printing head 16 and the cartridge 77 removably fixed to the carriage 13. In the second position, the hook 111 allows for the removal of the carriage 13 from the head 14 or the frame 76, together with the head 16 and the cartridge 77.

The hook 111 is formed by a lever 113 having a handle 114 for the actuation thereof projecting from the plane 23 of the carriage 13 and is held in the first position by a spring 116. The hook 111 is aligned with the plane 23 and in its first position can engage a shoulder 117 of a lower part of the ink jet head 14 or a shoulder 118 of a lower part of the frame 76.

The lever 113 has an inclined plane 121 on the upper part of the hook 111, while the ink jet head 14 and the frame 76 are provided in their lower parts with an inclined plane 122, 123 in front of the shoulder 117, 118 so as to promote mounting. The device 32 moreover comprises two grooves 124 formed in the plane 23 of the carriage 13 adjacent to the roller 17 adapted to be engaged by two lateral fins 126 and 127 of the ink jet head 14 and of the frame 76 to lock the head 14 or the frame 76 firmly on to the carriage 13.

For the electrical connection of the head 14 or 16 to the electronic unit 22, the flat cable 33 has an expanded end 131 supported at the upper plane 23 of the carriage 13 and held in position by a pair of lateral edges 132. The end 131 of the cable 33 comprises in one of its parts a platform 133 with a series of conductive areas 134. The platform 133 is placed on a rubber mat 137 housed in a seat 136 formed in the plane 23 of the carriage 13 adjacent to the grooves 124. The rubber mat 137 has a plurality of pegs 138 projecting from either side, adapted to cooperate with the platform 133 to keep it raised with respect to the other parts of the end 131.

The heads 14 and 16 are electrically connected for their operation to flat, flexible cables 139 and 141, provided at one end with respective platforms 142 and 143 with contact areas 144 and 146. The platform 142 is supported by a lower plane of the head 14, while the contact platform 143 is supported by a lower plane of the frame 76. When the head 14 or the head 16 is locked on the carriage 13, the platform 142 or 143 is coupled to the platform 133, with optimum electrical contact between the contact areas 134 and 144 or 146 of the superimposed platforms, ensured by the compression of the pegs 138.

The contact areas 134 of the platform 133 have an optimised arrangement for interfacing the contact areas 144 of the platform 142. If the ink jet head 14 is of the type used in the Ing. C. Olivetti & C., S.p.A. JP-350 printer, the platform 133 comprises sixty-two contact areas 134, fifty-eight of which mirror the contact areas 144 of the platform 142. This therefore ensures control of the fifty nozzles of the head 14 or of the nozzles of the color head 14' and other control functions, such as verifying the quantity of ink and determining the type of cartridge used. Four contact areas 134 in the platform 133, designated 145, do not correspond to any contact area 144 of the platform 142 for the head 14.

The wire head 16 can be activated by conductors, the number of which is well below that of the conductors required for the jet head 14 or 14'. The contact areas 146 of the platform 143 advantageously connect several contact areas 134 in parallel when the head 16 is mounted on the carriage 13. In the case of a head 16 having nine wires interchangeable with a head 14 having fifty nozzles, each of the nine conductors of the head 16 is connected, on the one hand, to a group of four contact areas 146 and the common return is connected to a group of twenty contact areas 147. When the head 16 is mounted on the carriage 13, the areas 134 of the platform 133 are connected in pairs by the common return of the platform 146 and by the contact area of one of the two activating conductors of the said head 16.

The electronic unit 22 (FIG. 8) is of the microprocessor type and comprises, e.g. a central processing unit (CPU) 151, a read only memory (ROM) 152, a random access memory (RAM) 153, an input output unit 154 and a head control circuit 156 connected to a data line 157, an address line 158 and a control line 159. The unit 22 comprises other circuits for connection to the exterior and control circuits not shown in the drawings.

A control circuit 161 for the ink jet head 14 and a control circuit 162 for the wire head 16 are connected to the control circuit 156, these in turn being interfaced via the flat cable 33 to the various contact areas of the platform 133.

The circuit 161 is adapted to be operated with impact printing heads with high resolution dot matrices, or with the fifty nozzles head 14 and supplies the conductors of the cable 33 with pulses of a low current intensity. The circuit 162 can operate with impact printing heads with medium resolution dot matrices, and can provide the conductors of the cable 33 with pulses of medium current intensity for the electromagnets of the head 16 which actuate the relevant wires.

The circuit 156 controls the two circuits 161 and 162 and is adapted to recognise which printing head 14 or 14' or 16 is mounted on the carriage 13 and to control it correctly. E.g. the circuit 156 can be sensitive to the conductive state of two of the contact areas 145 of the platform 133.

The circuit 156 will detect the presence of a head 14 or 14' if the areas 145 are not connected. It will detect the presence of a head 16 when the areas 145 are connected to one another.

The ink jet head 14 or the frame 76 is mounted on the carriage 13 as follows. Taking the head 14 or the frame 76, the lateral fins 126 and 127 are positioned in the respective grooves 124 and the head 14 or the frame 76 is thus lowered towards the front part of the printer 11. The inclined plane 122, 123 slides on the inclined plane 121 of the lever 113 against the action of the spring 116. As soon as the shoulder 117 of the head 114 or the shoulder 118 of the frame 76 passes the hook 111, the spring 116 releases the lever 113 to its first position in which the hook 111 is engaged with the shoulder 117, 118.

The head 14 or the frame 76 with its head 16 are thus locked on the carriage 13 and connected correctly to the electronic unit 22 in a rapid manner without the use of any tools.

When a printing head 14, 16 is mounted on the carriage 13 as described hereinbefore, the contact areas of the platform 142, 143 are superimposed upon the contact areas of the platform 133. In a starting phase of the printer 11, the circuit 156 recognises which type of head is mounted and enables the specific control circuit 161, 162 for the head 14, 16 the presence of which has been detected on the carriage 13.

In order to remove the ink jet head 14 or the frame 76 from the carriage 13, the handle 114 is pressed manually, thereby rotating the lever 113 against the action of the spring 116. The hook 111 is then positioned in the second position in which it is released from the shoulder 117, 118. The head 14 or the frame 76 can be removed from the carriage 13 once the lateral fins 126 and 127 have been removed from the grooves 124.

It is clear that the ink jet printing head 14 will be used for single copies and mainly for high-quality printing, while the wire printing head 16 will be used for multiple copies at a low unit cost for each printed character and with medium dot resolution.

It will be understood that various modifications and improvements can be made to the printer with interchangeable printing heads without thereby going beyond the scope of this invention.

What is claimed is:

1. Printer with interchangeable printing heads for printing documents, comprising:

a carriage for interchangeably holding one of an ink jet printing head having a plurality of ink ejecting nozzles and a frame supporting a wire printing head having a plurality of printing needles and moving said ink jet printing head or said frame in a forward direction and in a backward direction along a print line;

a fixing device for removably fixing said ink jet printing head or said frame supporting said wire printing head to said carriage;

sensing means for sensing the presence on said carriage of said ink jet printing head and of said wire printing head; and, a control device, responsive to said sensing means, for controlling the operation of said ink jet printing head and said wire printing head, said control device comprising activatable first driving means for driving said ink jet printing head and second driving means for driving said wire printing head, said first driving means being activated for supplying pulses of low current intensity to said ink jet printing head when said sensing means sense the presence on said carriage of said ink jet printing head, and said second driving means being activated for supplying pulses of medium current intensity to said ink jet printing head when said sensing means sense the presence on said carriage of said wire printing head, whereby single copy or multiple copies documents are printed;

wherein said frame also supports a removable cartridge for an ink ribbon, said ink ribbon being operatively associated with said plurality of printing needles in order to transfer ink from said ink ribbon to said documents, whereby the removal of said wire prim head from said carriage causes the simultaneous removal of said ink ribbon cartridge.

2. Printer according to claim 1, further comprising a ribbon feeding mechanism for feeding said ribbon in a feeding direction having an idle configuration and a working configuration, wherein said ribbon feeding mechanism assumes said working configuration when said frame supporting said wire head is locked on said carriage.

3. Printer according to claim 2, in which said ribbon feeding mechanism comprises a rack, and a kinematic unit adapted to assume a working position in engagement with said rack; and said frame supporting said wire head and said removable ribbon cartridge comprises a projecting extension adapted to cooperate with part of said kinematic unit to position it in said working position; wherein said kinematic unit assumes said working position when said ribbon feeding mechanism assumes said working configuration and said frame is locked on said carriage.

4. Printer according to claim 3, in which said kinematic unit comprises a first gear and a second gear selectively engageable with a series of toothed wheels engaged with one another, and a shaft actuated by one of said wheels and adapted to be coupled to a drive element for feeding said ribbon of said cartridge in said feeding direction, wherein, when said kinematic unit assumes said working position said first gear and said second gear engage with said rack, said first gear engaging with said series of toothed wheels when said carriage moves in said forward direction and said second gear engaging with said series of toothed wheels when said carriage moves in said backward direction, whereby said ribbon feeding mechanism always feed said ribbon in said feeding direction.

5. Printer according to claim 1, in which said ink jet head and said frame each have a shoulder, wherein said fixing device comprises a hook engageable with said shoulder and movable between a first and a second position, a lever hinged on to said carriage and connected to said hook and a spring adapted to hold said hook in said first position in which said hook engages with said shoulder and said hook, in said first position, locks said ink jet head or said frame on said carriage and, in the second position, allows said ink jet printing head or said frame to be removed.

6. Printer according to claim 1, in which said ink jet head and said wire head comprise respectively first and second electrical connection means for electrically connecting to said control device, said first and second connection means comprising a series of conductive areas respectively arranged on a first and a second platform; and said control device comprises third electrical connection means for electrically connecting to said ink jet head and said wire head, said third connection means comprising a third platform mounted on said carriage and having respective conductive areas, said first and second platforms being superimposable selectively by said third platform in order to establish an electrical connection between said ink jet head or alternately said wire head mounted on said carriage and said control device, wherein said sensing means are conditioned by reciprocal conductive states of said conductive areas of said third platform, and at least two of said conductive areas of said second platform are electrically interconnected.

* * * * *